US006581871B2

(12) United States Patent
Pijaca et al.

(10) Patent No.: US 6,581,871 B2
(45) Date of Patent: Jun. 24, 2003

(54) EXTENDABLE AND CONTROLLABLE FLIGHT VEHICLE WING/CONTROL SURFACE ASSEMBLY

(75) Inventors: Thomas Pijaca, Hackettstown, NJ (US); William J. Schellens, Cliffside Park, NJ (US)

(73) Assignee: Smiths Aerospace, Inc., Whippany, NJ (US)

( * ) Notice: Subject to any disclaimer, the term of this patent is extended or adjusted under 35 U.S.C. 154(b) by 0 days.

(21) Appl. No.: 09/873,498

(22) Filed: Jun. 4, 2001

(65) Prior Publication Data

US 2002/0179778 A1 Dec. 5, 2002

(51) Int. Cl.[7] ..... F42B 15/01

(52) U.S. Cl. ..... 244/3.27; 244/3.29; 244/3.24; 244/49

(58) Field of Search ..... 244/3.1, 3.24, 244/3.25, 3.26, 3.27, 3.28, 3.29, 3.3, 49

(56) References Cited

U.S. PATENT DOCUMENTS

| | | | | | |
|---|---|---|---|---|---|
| 4,336,914 | A | * | 6/1982 | Thomson | 244/3.27 |
| 4,575,025 | A | * | 3/1986 | Sadvary et al. | 244/3.27 |
| 4,709,877 | A | * | 12/1987 | Goulding | 244/3.28 |
| 5,480,111 | A | * | 1/1996 | Smith et al. | 244/3.27 |
| 5,582,364 | A | | 12/1996 | Trulin et al. | |
| 6,073,880 | A | * | 6/2000 | Voigt et al. | 244/3.24 |
| 6,186,443 | B1 | * | 2/2001 | Shaffer | 244/3.29 |
| 6,224,013 | B1 | * | 5/2001 | Chisolm | 244/3.27 |

FOREIGN PATENT DOCUMENTS

| | | |
|---|---|---|
| EP | 0 013 096 A | 7/1980 |
| EP | 0 803 701 A | 10/1997 |

* cited by examiner

*Primary Examiner*—Charles T. Jordan
*Assistant Examiner*—Gabriel S. Sukman
(74) *Attorney, Agent, or Firm*—Fish & Neave; Scott H. Kaliko; Joel Weiss

(57) ABSTRACT

The apparatus of the invention allows flight vehicle and/or guided munition wings and control surfaces to be secured in a retracted and locked position prior to the launch by a control surface retainer. An electro-mechanical differential control system preferably releases the control surface retainer, extends the control surfaces, and servo controls the control surfaces subsequent to launch. The invention also provides a method for guiding a flight vehicle and/or guided munition by releasing the flight vehicle's and/or guided munition's control surface from a control surface retainer, extending the flight vehicle's and/or guided munition's wing/control surface assembly using a wing/control surface actuation system, and controlling the flight vehicle's and/or guided munition's control surfaces using a wing/control surface actuation system.

67 Claims, 8 Drawing Sheets

EXTENDABLE AND CONTROLLABLE FLIGHT VEHICLE WING/CONTROL SURFACE ASSEMBLY

BACKGROUND OF THE INVENTION

This invention relates to extendable and controllable wings and control surfaces on a flight vehicle and/or a guided munition. More particularly this invention relates to a device and method for pre-launch retainment and post-launch deployment of wings and control surfaces on a flight vehicle and/or a guided munition, as well as post-launch control of the flight vehicle's and/or the guided munition's control surfaces.

A significant disadvantage of conventional flight vehicles and guided munitions that deploy wings and control surfaces after launch is that they employ complicated or dangerous deployment techniques. Specifically, these techniques include hydraulics, pyrotechnics, compressed springs, and pneumatics generated from a pyrotechnic device.

One drawback associated with the use of pyrotechnics is that pyrotechnics have a limited shelf life and must be periodically replaced.

Another drawback with the use of pyrotechnics is that one is precluded from repeatedly testing the device due to the fact that pyrotechnics are limited to a one time use.

Yet another drawback of conventional flight vehicles and guided munitions is that control over the deployment of the wings and control surfaces is accomplished separately from the control over the control surfaces during flight. This involves more parts. Additional parts increase the risk of failure due to part malfunction and also increases the overall weight of the flight vehicle and/or guided munition.

Yet still another drawback of conventional flight vehicles and guided munitions is that flight failures have occurred due to non-uniform deployment of wings and control surfaces.

It therefore would be desirable to provide a flight vehicle and/or a guided munition wing/control surface deployment device that reduces the danger to personnel handling the device.

It would also be desirable to provide a flight vehicle and/or a guided munition wing/control surface deployment device that does not have a limited shelf life.

It would further be desirable to provide a flight vehicle and/or a guided munition wing/control surface deployment device that may be repeatedly tested without a single use limitation.

It would still further be desirable to provide a device that controls both the deployment of the wings and control surfaces and controls the control surfaces during flight.

It would yet still further be desirable to provide a system that ensures uniform deployment of a wings and control surfaces for a flight vehicle and/or a guided munition.

SUMMARY OF THE INVENTION

Therefore, it is an object of this invention to provide a flight vehicle and/or a guided munition wing/control surface deployment device that reduces the danger to personnel handling the device.

It is also an object of this invention to provide a flight vehicle and/or a guided munition wing/control surface deployment device that does not have a limited shelf life.

It is a further object of this invention to provide a flight vehicle and/or a guided munition wing/control surface deployment device that may be repeatedly tested without a single use limitation.

It is still further an object of this invention to provide a device that controls the deployment of the wings and control surfaces and also controls the control surfaces during flight.

It is a yet still further an object of this invention to provide a system that ensures uniform deployment of wings and control surfaces for a flight vehicle and/or a guided munition.

In accordance with this invention an apparatus including a control surface retainer system, a wing/control surface actuation system, and may include a uniform wing/control surface deployment system is provided. The control surface retainer system prevents the wings and/or control surfaces from extending prior to the launch of a flight vehicle. The wing/control surface actuation system releases the control surface retainer, extends the wing/control surface assembly locking the assembly into position at a predetermined angle, and servo controls the control surfaces to direct the flight vehicle and/or the guided munition to a target. The uniform wing/control surface deployment works in conjunction with the wing/control surface actuation system to ensure uniform deployment of the wing/control surface assemblies.

Another aspect of the invention includes a method for releasing a wing/control surface assembly from a retracted position, extending a wing/control surface assembly to a predetermined angle using a wing/control surface actuation system, and controlling a control surface to guide the flight vehicle and/or the guided munition to a target using the wing/control surface actuation system.

A further aspect of this invention may include a method for releasing a wing/control surface assembly from a retracted position, extending uniformly a plurality of wing/control surface assemblies to a predetermined angle using a plurality of wing/control surface actuation systems, and controlling a control surface to guide the flight vehicle and/or the guided munition to a target using the wing/control surface actuation system.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout.

DETAILED DESCRIPTION OF THE INVENTION

Figure 1:
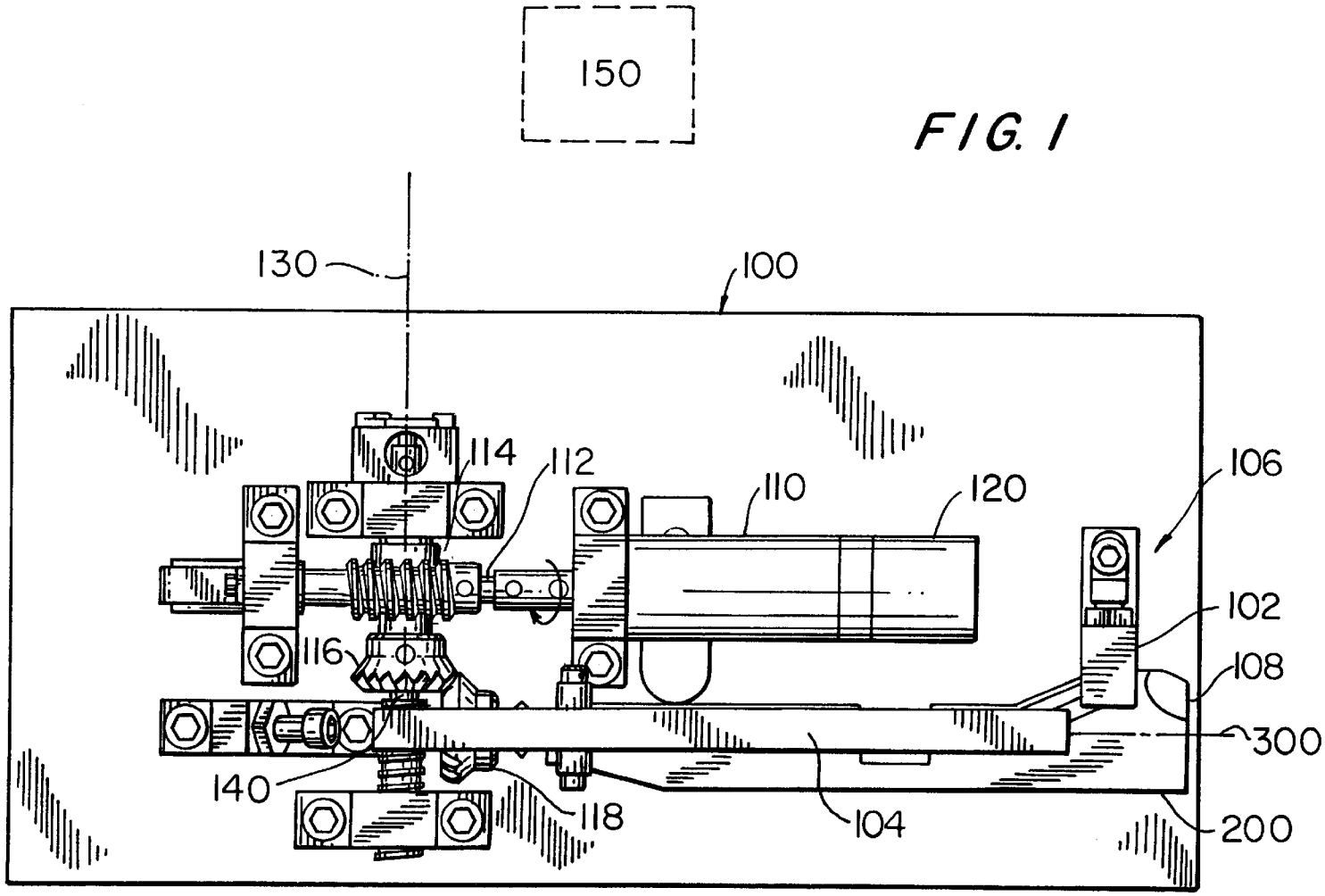
FIG. 1 is a top view of a schematic diagram according to the invention where the flight vehicle and/or the guided munition control surface is in a stowed and locked position.

An apparatus according to the invention includes a control surface retainer system, a wing/control surface actuation system, and may include a uniform wing/control surface deployment system. The control surface retainer system preferably retains a wing/control surface assembly until launch. Then, after the launch, the wing/control surface actuation system preferably unlocks and deploys a wing/control surface assembly. The uniform wing/control surface deployment system controls the uniform deployment of a plurality of wing/control surface assemblies. Then, following deployment, the system moves the control surface with respect to the wing as part of a control surface servo control system.

The control surface retainer system locks the flight vehicle's and/or the guided munition's wing/control surface assembly in a retracted position prior to the launch of the flight vehicle and/or the guided munition. Subsequent to launch the wing/control surface actuation system uses a differential with one input and two outputs. The two differential outputs are as follows: 1) the output may cause the control surface to rotate about a rotation axis and 2) the output may cause the wing/control surface assembly to extend from the flight vehicle and/or the guided munition. Additionally, subsequent to launch, if a plurality of wing/control surface actuation systems cause a plurality of wing/control surface assemblies to be deployed, the uniform deployment system ensures that the wing/control surface assemblies are deployed uniformly with respect to one another.

In a preferred embodiment of the invention, this differential is implemented using two bevel gears. A first bevel gear provides a rotational force as an input to the wing/control surface actuation system. The second bevel gear, which is preferably meshed to, and positioned at a 90° angle to, the first bevel gear, has one of two possible responses, each of which correspond to one of the differential outputs listed above, to the input rotation provided by the first bevel gear.

One possible response is to cause the control surface to rotate about a substantially central longitudinal rotational axis of the control surface. The other possible response is to move in a rotational direction about a central longitudinal rotational axis of the first bevel gear and, thereby, to extend outward from the flight vehicle and/or guided munition. In general, the output is determined only when one of the possible outputs is restricted. Restriction of the outputs may be implemented according to design choices.

The differential system according to the invention uses a first output to unlock the flight vehicle's and/or guided munition's control surface retainer and utilizes the second output to extend the flight vehicle's and/or guided munition's wing/control surface assembly to a predetermined fixed position, as will be explained in greater detail below. Once the wing/control surface assembly is deployed and positioned in the fixed position, the second output is restricted. Thereafter, the differential system returns to using the first output. At this point, the first output is no longer required to unlock the wing/control surface assembly. Rather, the first output can be utilized to act as a servo control over the flight vehicle's and/or guided munition's control surface to guide the flight vehicle and/or guided munition.

Additionally, if a plurality of wing/control surface actuation systems cause a plurality of wing/control surface assemblies to be deployed, these assemblies may be uniformly deployed using a uniform wing/control surface deployment system.

One embodiment of this uniform wing/control surface deployment system may include a mechanical link (e.g., arc bevel gears, spur gears, rubber tired wheel, and chain, etc.) between a plurality of wing/control surface assemblies. This mechanical link may include a plurality of arc bevel gears. Each bevel gear is fixed to a wing/control surface assembly and may be positioned at an angle greater than 0° and less than or equal to 180° with respect to one another. The exact angle between these gears will be determined by the number of wing/control surface assemblies actually deployed.

As each wing/control surface assembly deploys, these bevel gears rotate in the direction of the wing/control surface assembly deployment. As these gears rotate, they mesh with each other, thereby preventing each wing/control surface assembly from deploying asymmetrically. By controlling the rate at which each wing/control surface assembly may deploy, these gears cause the individual rotational forces to be added together, creating a total rotational force.

The total force generated is distributed equally among each of the wing/control surface assemblies, such that these assemblies are substantially uniformly deployed.

Figure 2:
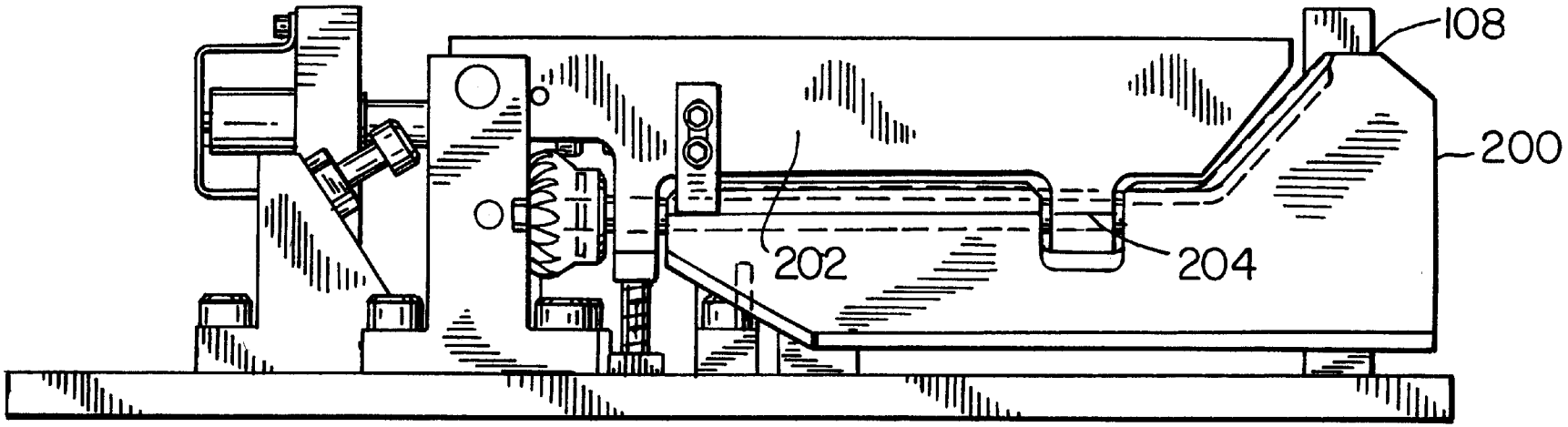
FIG. 2 is a side view of a schematic diagram according to the invention where the flight vehicle and/or the guided munition control surface is in a stowed and locked position.
Figure 3:
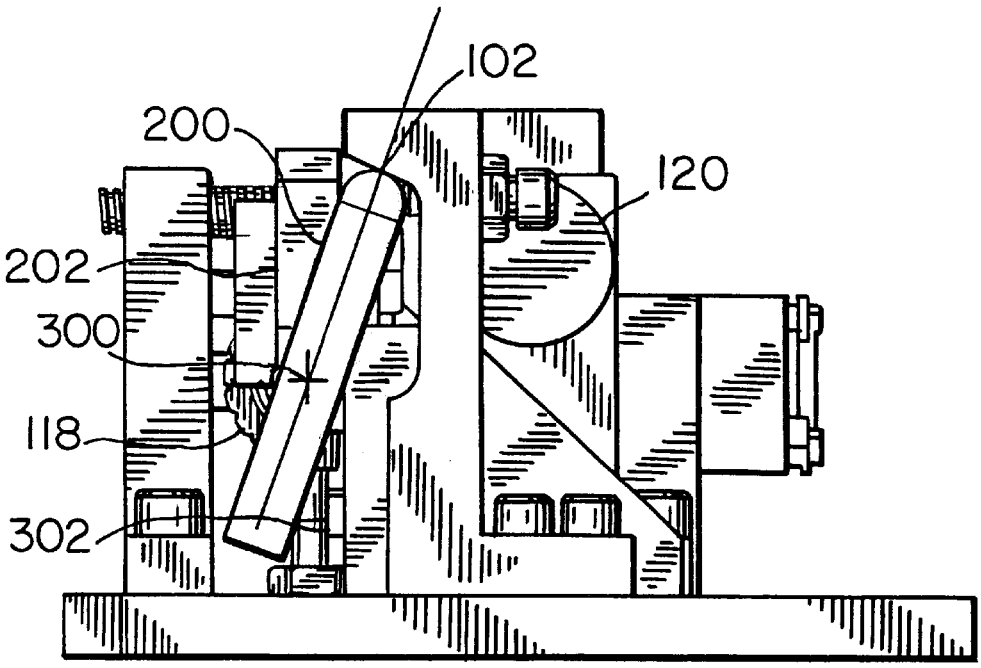
FIG. 3 is an end view of a schematic diagram according to the invention where the flight vehicle and/or the guided munition control surface is in a stowed and locked position.

FIGS. 1–3 show a top, side, and end view of a schematic diagram of one embodiment of an apparatus 100 according to the invention. In these views, flight vehicle/guided munition wing/control surface assembly 104 is stowed and locked. The control surface retainer system includes stow notch 102 mounted in flight vehicle/guided munition frame 106. The wing/control surface assembly preferably includes a stow tab 108 that corresponds to stow notch 102. In this particular embodiment, a rotation of control surface 200 releases stow tab 108 from stow notch 102, as will be explained.

Stow notch 102 is preferably fixed to frame 106. Control surface 200 is preferably hinge-mounted by hinge 204 to wing 202, and is rotatable about control surface rotation axis 300. Additionally, stow tab 108 is integrated into control surface 200. These FIGS. also show motor 110, worm shaft 112, worm wheel 114, first bevel gear 116, second bevel gear 118 and position reporting device 120. Preferably, position reporting device 120 is located directly on fin shaft 140. Position reporting device may also be located on the rear of motor 110.

Figure 4:
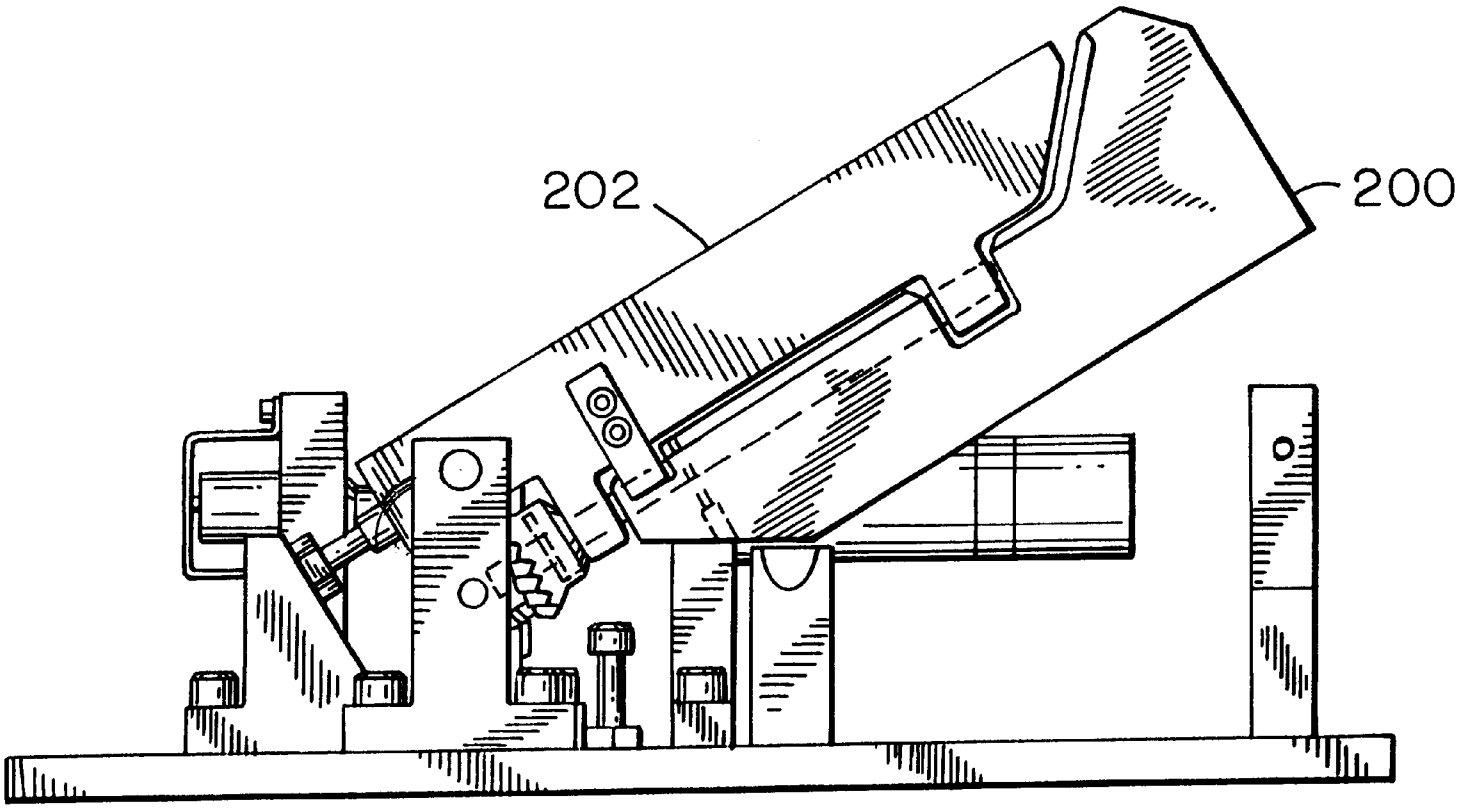
FIG. 4 is a side view of a schematic diagram according to the invention where the flight vehicle and/or the guided munition control surface is fully deployed.
Figure 5:
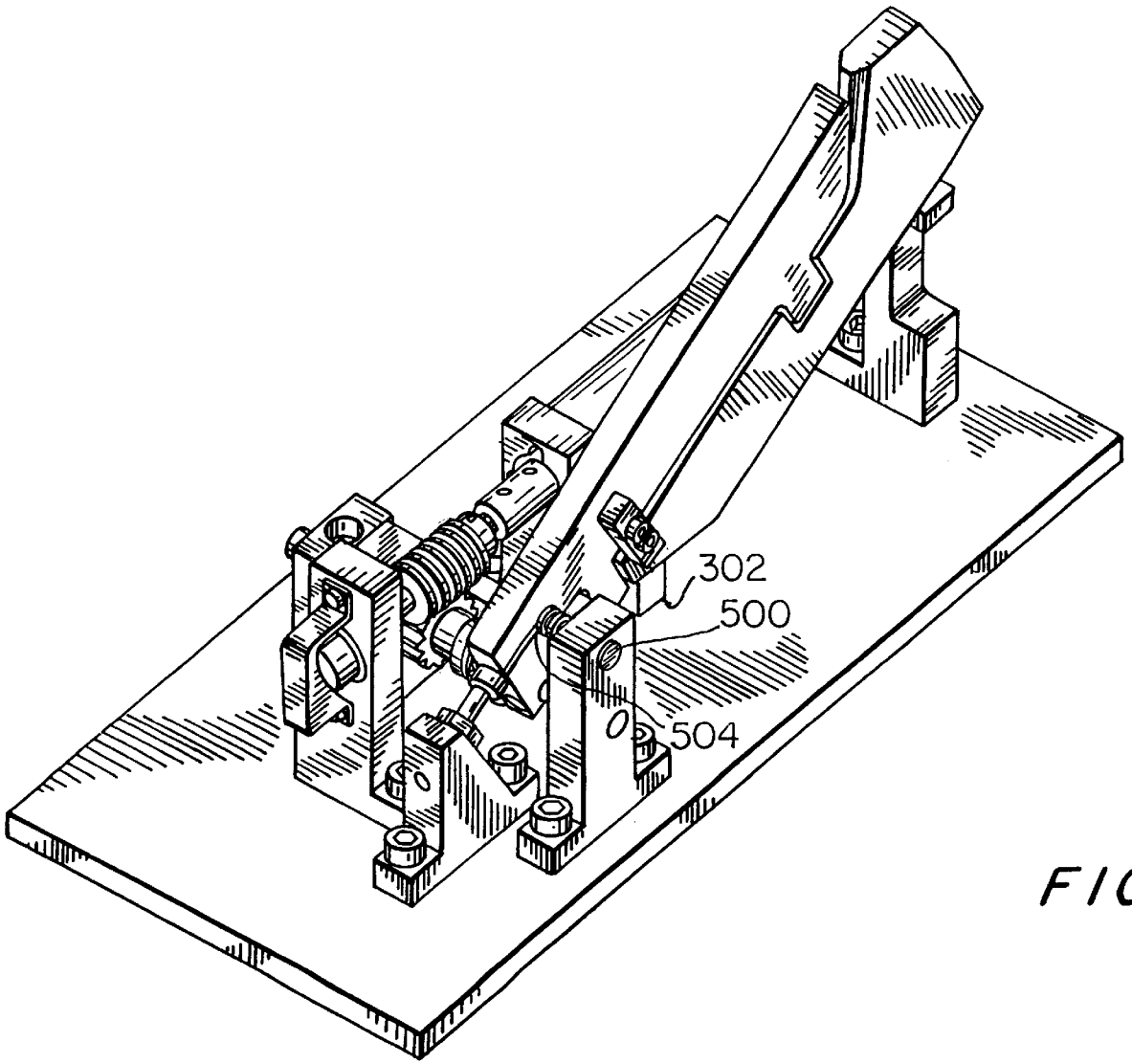
FIG. 5 is a front isometric view of a schematic diagram according to the invention where the flight vehicle and/or the guided munition control surface is fully deployed.
Figure 6:
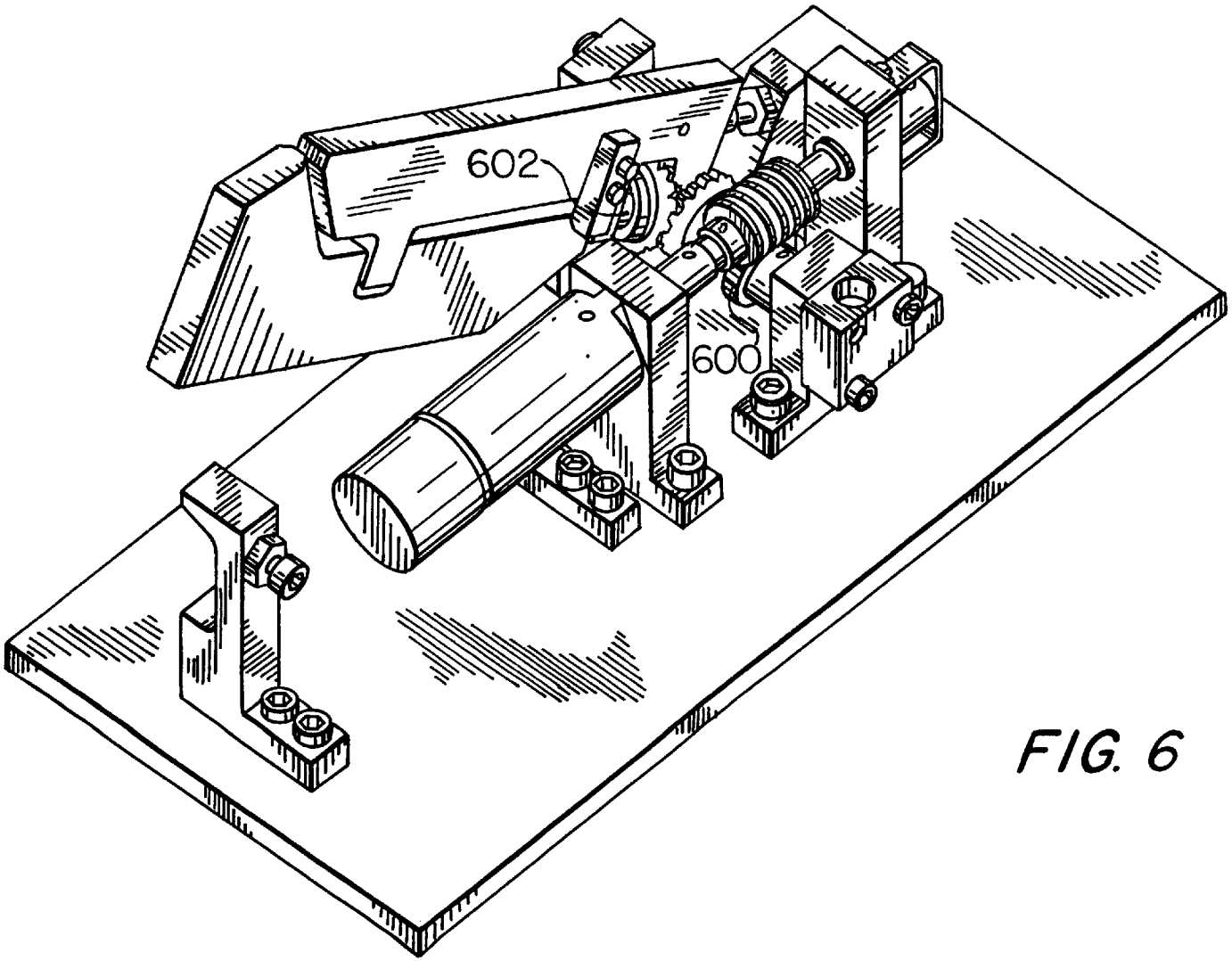
FIG. 6 is a rear isometric view of a schematic diagram according to the invention where the flight vehicle and/or the guided munition control surface is fully deployed.

FIGS. 4–6 show additional views of apparatus 100. In these views, wing/control surface assembly 104 is extended and deployed. These views more clearly illustrate the wing/control surface actuation system which provides the rotational force required by apparatus 100.

The wing/control surface actuation system includes motor 110 that rotates worm shaft 112. The rotation of worm shaft 112 causes worm 114 to rotate. Worm 114, in turn, drives worm wheel 600. Worm wheel 600 drives first bevel gear 116. First bevel gear 116 rotates with worm wheel 600 and drives second bevel gear 118. Second bevel gear 118 is preferably attached to wing/control surface assembly 104 by shaft 602. The two different responses of second bevel gear 118 to the rotation of first bevel gear 116 will be explained below.

Apparatus 100 operates as follows. When the flight vehicle and/or guided munition is launched, the locked and stowed position of the control surface is reported by position reporting device 120 to a suitable control mechanism 150— e.g., a microprocessor. The control commands motor 110 to rotate worm shaft 112. Worm shaft 112 rotates worm 114 in the direction to unblock the wing. If worm 114 is a right hand worm, the direction will be as shown by the arrow in FIG. 1. Worm 114 in turn drives worm wheel 600. Worm wheel 600 then drives first bevel gear 116, which meshes with second bevel gear 118.

The rotation of second bevel gear 118, which is attached to wing/control surface assembly 104 by shaft 602, rotates the stow tab 108 out of stow notch 102. This output of the differential is selected because the alternative option of the differential output—i.e., to lift second bevel gear 118 and rotate it [together with wing/control surface apparatus 104] about first bevel gear axis 130 in order to accommodate the rotation of first bevel gear 116 is not available. This option is not available because the leading edge of control surface 200 is restrained from moving in a direction having a component of motion perpendicular to axis 300 by stow notch 102. Thus, the first response from the differential to the rotation of first bevel gear 116 is to rotate control surface 200 about axis 300.

Preferably substantially simultaneously to stow tab 108 clearing stow notch 102, the trailing edge of control surface 200 strikes guide block 302, preventing further rotation of control surface 200 about axis 300.

Because the first output response—i.e., to rotate control surface 200 about axis 300—is not available, then the second output response—i.e., to cause second bevel gear 118 to rotate about axis 130, and, thereby, to deploy or extend the wing/control surface assembly—is carried out. This occurs when the trailing edge of control surface 200 is stopped from rotating by guide block 302. It is important to note that if both of the output options would have been available—i.e., non-restricted—the result of the input would have been substantially indeterminate.

When wing/control surface assembly 104 moves to a predetermined angle, spring-loaded pin 500 locks wing/control surface assembly 104 into place via pin hole 504. Once wing/control surface assembly 104 is locked into position, extension of the wing/control surface assembly from the flight vehicle and/or guided munition is restricted. Thus, the second output of the differential is no longer available.

But, at this point, the trailing edge of control surface 200 has cleared guide block 302 and can move freely with respect to guide block 302 and wing 202. Thus, the output of the differential returns to the first output response which preferably causes rotation of control surface 200 about control surface axis 300. This rotation can be utilized by control mechanism 150 to direct motor 110 to control control surface 200 such as to guide the flight vehicle and/or guided munition. One purpose of controlling control surface 200 is to guide the flight vehicle and/or guided munition. This control may be implemented by utilizing control surface position information from position reporting device 120 and target information provided by an external source.

Figure 7:
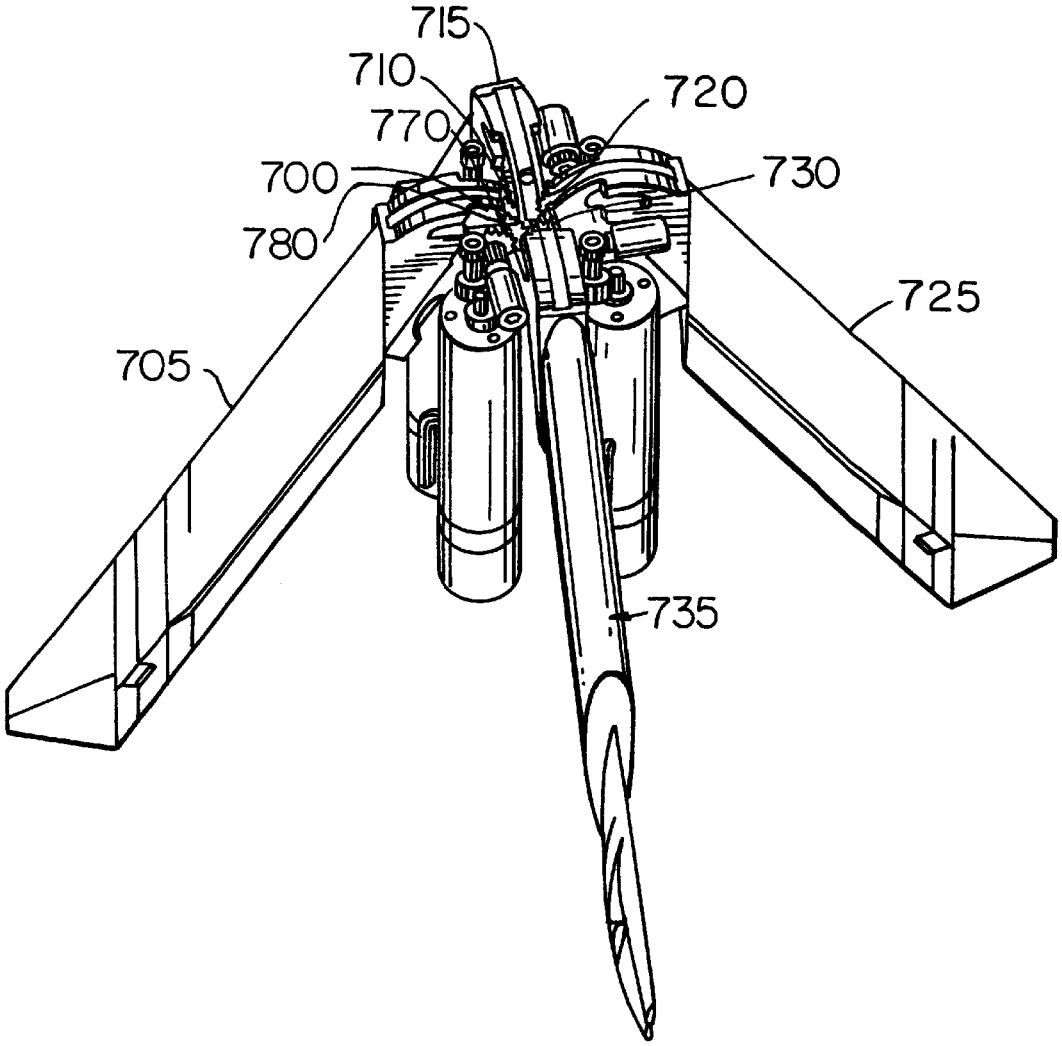
FIG. 7 is a perspective diagram according to the invention where the flight vehicle and/or the guided munition control surface assemblies are uniformly deployed.

FIG. 7 shows a perspective diagram of one embodiment according to the invention. This view illustrates one embodiment of the uniform wing/control surface deployment system. The uniform wing/control surface deployment system, in this illustrative example, includes arc bevel gears 700, 710, 720, and 730. Furthermore, in this illustration, wing/control surface assemblies 705, 715, 725, and 735 are also shown. Arc bevel gear 700 is preferably fixed to 705, arc bevel gear 710 is preferably fixed to 715, arc bevel gear 720 is preferably fixed to 725, arc bevel gear 730 is preferably fixed to 735. In this particular embodiment arc bevel gears 700, 710, 720, and 730 are at 90° angles with respect to one another.

As wing/control surface assemblies 705, 715, 725, and 735 deploy, arc bevel gear 700, 710, 720, and 730 mesh at a point tangent to one another's adjacent gear, e.g. gear 700 meshes to gear 710 and 730 at tangent points 770 and 780. Thus, wing/control surface assemblies 705, 715, 725, and 735 are forced to deploy uniformly.

Figure 8:
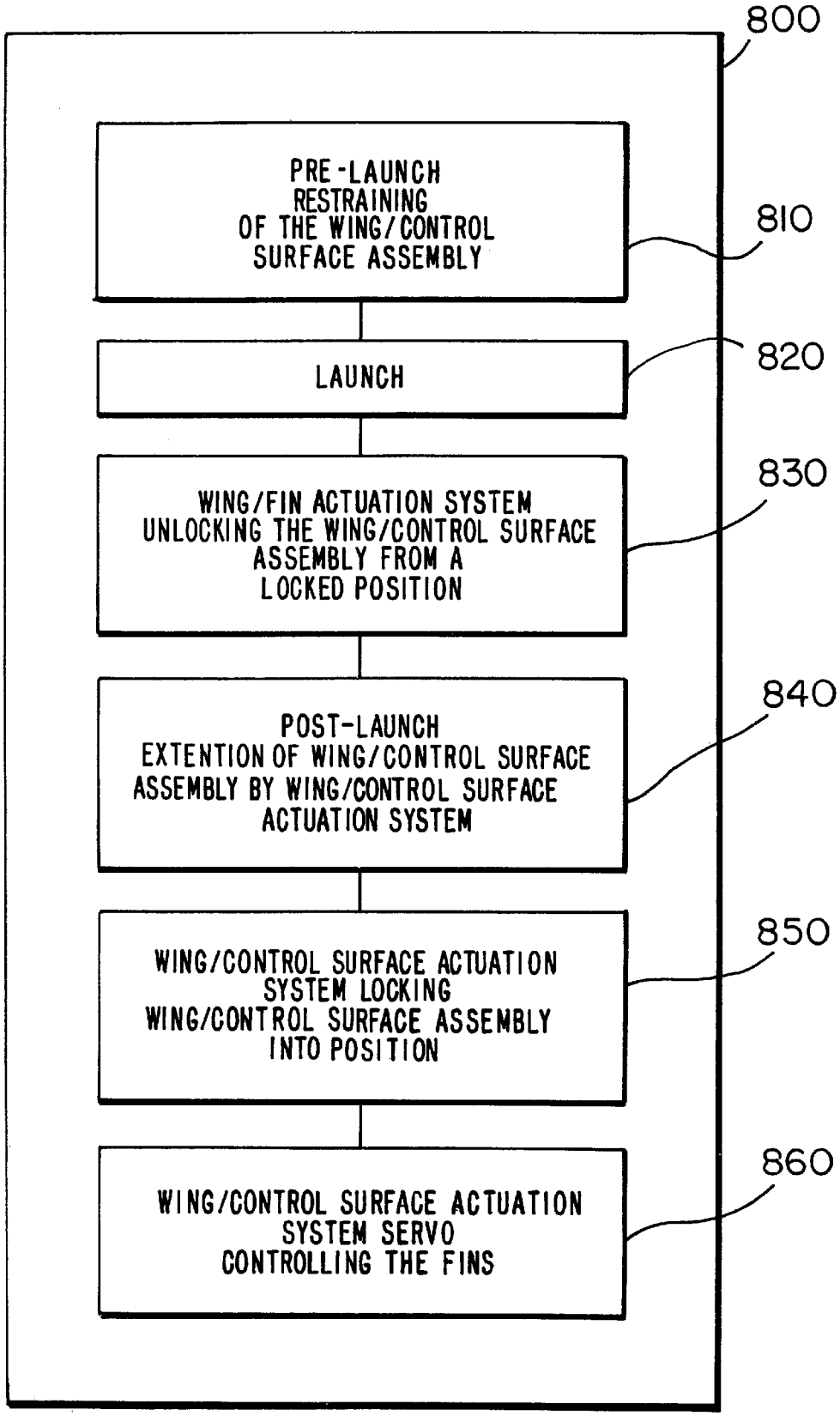
FIG. 8 is a flow chart according to the invention.

FIG. 8 shows a flow chart 800 of the operation of an apparatus according to the invention. Box 810 shows the pre-launch restraining of the wing/control surface assembly. Box 820 shows the launch. Box 830 shows the wing/control surface actuation system unlocking the wing/control surface assembly from the locked position. Box 840 shows the preferably post-launch extension of the wing/control surface assembly by the wing/control surface actuation system. Box 850 shows the wing/control surface actuation system locking the wing/control surface assembly in its proper position. Box 860 shows the wing/control surface actuation system servo controlling the control surface in order to guide the flight vehicle and/or guided munition.

Thus, an extendable and controllable flight vehicle and/or guided munition wing/control surface actuation system is provided. Persons skilled in the art will appreciate that the present invention can be practiced by other than the described embodiments, which are presented for purposes of illustration rather than of limitation, and the present invention is limited only by the claims which follow.

What is claimed is:

1. An apparatus for controlling a wing/control surface assembly of a guided munition, the assembly comprising a wing and a control surface, the apparatus comprising:

a control surface retainer that prevents the wing/control surface assembly from extending prior to launch; and that rotatably removes the wing/control surface a wing/control surface actuation system the control surface retainer and servo control surface with respect to the wing, wherein the rotation that releases the wing/control surface assembly is about a substantially central longitudinal axis of the control surface.

2. The apparatus in claim 1, further comprising: a plurality of wing/control surface assemblies; and a uniform wing/control surface deployment system that uniformly deploys the plurality of wing/control surface assemblies.

3. The apparatus in claim 2, wherein said uniform wing/control surface deployment system comprises a mechanical link between adjacent wing/control surface assemblies.

4. The apparatus, in claim 3, wherein said mechanical link comprises arc bevel gears; each of the arc bevel gears is located on each of the adjacent wing/control surface assemblies, wherein the arc bevel gears mesh with respect to one another.

5. The apparatus in claim 1, wherein the control surface retainer comprises:

a control surface hinge mounted to the wing;

a stow notch fixed in a frame of the guided munition to secure the control surface to the frame; and wherein a rotation of the control surface about a rotational axis releases the control surface from the notch.

6. The apparatus in claim 1, wherein said wing/control surface actuation system comprises a differential with one input and two outputs wherein a single rotational input selectably controls one of an actuation of the wing/control surface assembly and a servo control of the control surface.

7. The apparatus in claim 6, wherein said differential comprises:

a first bevel gear to provide a rotational force input; and a second bevel gear meshed to said first bevel gear such that rotation of said first bevel gear causes said second bevel gear to provide a selectable one of a first output and a second output.

8. The apparatus in claim 7, wherein said second bevel gear is positioned at a 90 degree angle to said first bevel gear.

9. The apparatus in claim 7, wherein said first output causes said control surface to rotate about a rotation axis with respect to the wing.

10. The apparatus of claim 7, wherein said second output causes said wing/control surface assembly to extend outward with respect to the guided munition to a predetermined position.

11. The apparatus in claim 7, wherein a selected one of said first output and said second output is selected when a non-selected one of said first output and second output is restricted.

12. The apparatus of claim 7, wherein said first output is restricted through the use of a guide block that prevents said control surface from rotating after said control surface clears a stow notch.

13. The apparatus of claim 12, wherein said guide block comprises a height reference, said height reference corresponding to the deployed position of the wing/control surface assembly.

14. The apparatus in claim 7, further comprising a spring loaded pin moveably mounted in the guided munition frame, the wing further comprising a pin hole, and wherein the second output is restricted by engaging the pin in the pin hole.

15. The apparatus in claim 2, wherein the control surface retainer comprises:

a control surface hinge mounted to the wing;

a stow notch fixed in a frame of the guided munition to secure the control surface to the frame; and wherein a rotation of the control surface about a rotational axis releases the control surface from the notch.

16. The apparatus of claim 2, wherein said wing/control surface assembly comprises a differential with one input and two outputs wherein a single rotational input selectably controls one of an actuation of the wing/control surface assembly and a servo control of the control surface.

17. The apparatus in claim 16, wherein said differential comprises:

a first bevel gear to provide a rotational force input; and a second bevel gear meshed to said first bevel gear such that rotation of said first bevel gear causes said second bevel gear to provide a selectable one of a first output and a second output.

18. The apparatus in claim 17, wherein said second bevel gear is positioned at a 90 degree angle to said first bevel gear.

19. The apparatus in claim 17, wherein said first output causes said control surface to rotate about a rotation axis with respect to the wing.

20. The apparatus of claim 17, wherein said second output causes said wing/control surface assembly to extend outward with respect to the guided munition to a predetermined position.

21. The apparatus in claim 17, wherein a selected one of said first output and said second output is selected when a non-selected one of said first output and second output is restricted.

22. The apparatus of claim 17, wherein said first output is restricted through the use of a guide block that prevents said control surface from rotating after said control surface clears a stow notch.

23. The apparatus of claim 22, wherein said guide block comprises a height reference, said height reference corresponding to the deployed position of the wing/control surface assembly.

24. The apparatus in claim 17, further comprising a spring loaded pin moveably mounted in the guided munition frame, the wing further comprising a pin hole, and wherein the second output is restricted by engaging the pin in the pin hole.

25. A method for guiding a guided munition, the guided munition having a wing/control surface assembly including a wing and a control surface, said method comprising the steps of:

rotatably releasing the control surface from a control surface retainer, wherein the rotation that releases the wing/control surface assembly is about a substantially central longitudinal axis of the control surface;

extending the wing/control surface assembly from the guided munition using a wing/control surface actuation system; and controlling the control surface using the wing/control surface actuation system.

26. The method in claim 25, wherein the extending wing/control surface assembly comprises extending the wing/control surface assembly to a fixed position.

27. The method in claim 26, wherein the releasing, extending, and controlling comprises releasing, extending, and controlling using a differential.

28. The method in claim 27, wherein the releasing, extending, and controlling using a differential comprises releasing, extending, and controlling utilizing one input, a first output, and a second output.

29. The method in claim 28, wherein the releasing, extending, and controlling comprises releasing, extending, and controlling utilizing a motor.

30. The method in claim 28, further comprising using the first output for releasing the wing/control surface assembly and for controlling the guided munition's control surface.

31. The method in claim 28, wherein the extending comprises extending using the second output.

32. The method in claim 25, wherein the extending of the wing/control surface assembly comprises extending the wing/control surface assembly to a predetermined position and fixing the wing/control surface assembly at the predetermined position.

33. The method in claim 25, further comprising extending a plurality of wing/control surface assemblies uniformly with respect to one another.

34. An apparatus for controlling a wing/control surface assembly of a flight vehicle, the assembly comprising a wing and a control surface, the apparatus comprising:

control surface retainer that prevents the wing/control surface assembly from extending prior to launch; and a wing/control surface actuation system that rotatably removes the wing/control surface assembly from the control surface retainer and servo controls the control surface with respect to the wing, wherein the rotation that releases the wing/control surface assembly is about a substantially central longitudinal axis of the control surface.

35. The apparatus in claim 34, further comprising:

a plurality of wing/control surface assemblies; and a uniform wing/control surface deployment system that uniformly deploys the plurality of wing/control surface assemblies.

36. The apparatus in claim 35, wherein said uniform wing/control surface deployment system comprises a mechanical link between adjacent wing/control surface assemblies.

37. The apparatus, in claim 36, wherein said mechanical link comprises arc bevel gears; each of the arc bevel gears is located on each of the adjacent wing/control surface assemblies, wherein the arc bevel gears mesh with respect to one another.

38. The apparatus in claim 34, wherein the control surface retainer comprises:

a control surface hinge mounted to the wing;

a stow notch fixed in a frame of the flight vehicle to secure the control surface to the frame; and wherein a rotation of the control surface about a rotational axis releases the control surface from the notch.

39. The apparatus in claim 34, wherein said wing/control surface actuation system comprises a differential with one input and two outputs wherein a single rotational input selectably controls one of an actuation of the wing/control surface assembly and a servo control of the control surface.

40. The apparatus in claim 39, wherein said differential comprises:

a first bevel gear to provide a rotational force input; and a second bevel gear meshed to said first bevel gear such that rotation of said first bevel gear causes said second bevel gear to provide a selectable one of a first output and a second output.

41. The apparatus in claim 40, wherein said second bevel gear is positioned at an angle to said first bevel gear.

42. The apparatus in claim 40, wherein said first output causes said control surface to rotate about a rotation axis with respect to the wing.

43. The apparatus in claim 40, wherein said second output causes said wing/control surface assembly to extend outward with respect to the flight vehicle to a predetermined position.

44. The apparatus in claim 40, wherein a selected one of said first output and said second output is selected when a non-selected one of said first output and second output is restricted.

45. The apparatus of claim 40, wherein said first output is restricted through the use of a guide block that prevents said control surface from rotating after said control surface clears a stow notch.

46. The apparatus of claim 45, wherein said guide block comprises a height reference, said height reference corresponding to the deployed position of the wing/control surface assembly.

47. The apparatus in claim 40, further comprising a spring loaded pin moveably mounted in the flight vehicle frame, the wing further comprising a pin hole, and wherein the second output is restricted by engaging the pin in the pin hole.

48. The apparatus in claim 35, wherein the control surface retainer comprises:

a control surface hinge mounted to the wing;

a stow notch fixed in a frame of the flight vehicle to secure the control surface to the frame; and wherein a rotation of the control surface about a rotational axis releases the control surface from the notch.

49. The apparatus in claim 35, wherein said wing/control surface actuation system comprises a differential with one input and two outputs wherein a single rotational input selectably controls one of an actuation of the wing/control surface assembly and a servo control of the control surface.

50. The apparatus in claim 49, wherein said differential comprises:

a first bevel gear to provide a rotational force input; and a second bevel gear meshed to said first bevel gear such that rotation of said first bevel gear causes said second bevel gear to provide a selectable one of a first output and a second output.

51. The apparatus in claim 50, wherein said second bevel gear is positioned at an angle to said first bevel gear.

52. The apparatus in claim 50, wherein said first output causes said control surface to rotate about a rotation axis with respect to the wing.

53. The apparatus in claim 50, wherein said second output causes said wing/control surface assembly to extend outward with respect to the flight vehicle to a predetermined position.

54. The apparatus in claim 50, wherein a selected one of said first output and said second output is selected when a non-selected one of said first output and second output is restricted.

55. The apparatus of claim 50, wherein said first output is restricted through the use of a guide block that prevents said control surface from rotating after said control surface clears a stow notch.

56. The apparatus of claim 55, wherein said guide block comprises a height reference, said height reference corresponding to the deployed position of the wing/control surface assembly.

57. The apparatus in claim 50, further comprising a spring loaded pin moveably mounted in the flight vehicle frame, the wing further comprising a pin hole, and wherein the second output is restricted by engaging the pin in the pin hole.

58. A method for guiding a flight vehicle, the flight vehicle having a wing/control surface assembly including a wing and a control surface, said method comprising the steps of:

rotatably releasing the control surface from a control surface retainer, wherein the rotation that releases the wing/control surface assembly is about a substantially central longitudinal axis of the control surface;

extending the wing/control surface assembly from the flight vehicle using the wing/control surface actuation system; and controlling the control surface using the wing/control surface actuation system.

59. The method in claim 58, wherein the extending wing/control surface assembly comprises extending the wing/control surface assembly to a fixed position.

60. The method in claim 59, wherein the releasing, extending, and controlling comprises releasing, extending, and controlling using a differential.

61. The method in claim 60, wherein the releasing, extending, and controlling using a differential comprises releasing, extending, and controlling utilizing one input, a first output, and a second output.

62. The method in claim 61, wherein the releasing, extending, and controlling comprises releasing, extending, and controlling utilizing a motor.

63. The method in claim 61, further comprising using the first output for releasing the wing/control surface assembly and for controlling the flight vehicle's control surface.

64. The method in claim 61, wherein the extending comprises extending using the second output.

65. The method in claim 58, wherein the extending of the wing/control surface assembly comprises extending the wing/control surface assembly to a predetermined position and fixing the wing/control surface assembly at the predetermined position.

66. The method in claim 58, further comprising extending a plurality of wing/control surface assemblies uniformly with respect to one another.

67. An apparatus for controlling a plurality of wing/control surface assemblies of a guided munition, the assembly comprising a wing and a control surface, the apparatus comprising:

a control surface retainer that prevents the wing/control surface assembly from extending prior to launch; and a uniform wing/control surface deployment system that uses a mechanical link between adjacent wing/control surface assemblies to uniformly deploys the plurality of wing/control surface assemblies with respect to the guided munition and servo controls the control surface with respect to the wing.

* * * * *